US011205876B1

(12) United States Patent
Liu

(10) Patent No.: US 11,205,876 B1
(45) Date of Patent: Dec. 21, 2021

(54) LOCK STRUCTURE OF CONNECTOR ASSEMBLY

(71) Applicant: ACES ELECTRONICS CO., LTD., Taoyuan (TW)

(72) Inventor: Yuan-Huang Liu, Taoyuan (TW)

(73) Assignee: ACES ELECTRONICS CO., LTD., Taoyuan (TW)

( * ) Notice: Subject to any disclaimer, the term of this patent is extended or adjusted under 35 U.S.C. 154(b) by 0 days.

(21) Appl. No.: 16/909,288

(22) Filed: Jun. 23, 2020

(51) Int. Cl.
*H01R 13/639* (2006.01)
*H01R 13/6581* (2011.01)
*H01R 13/633* (2006.01)

(52) U.S. Cl.
CPC ..... *H01R 13/639* (2013.01); *H01R 13/6335* (2013.01); *H01R 13/6581* (2013.01)

(58) Field of Classification Search
CPC ..... H01R 13/639; H01R 13/6335; H01R 13/6581
See application file for complete search history.

(56) References Cited

U.S. PATENT DOCUMENTS 8,147,269 B2 * 4/2012 Yamaji ..... H01R 12/7047 439/372
2005/0208802 A1 * 9/2005 Kikuchi ..... H01R 12/7005 439/157
2009/0186508 A1 * 7/2009 Kikuchi ..... H01R 43/26 439/304
2009/0186514 A1 * 7/2009 Kato ..... H01R 13/6275 439/372
2010/0159728 A1 * 6/2010 Wang ..... H01R 13/112 439/312
2012/0094519 A1 * 4/2012 Ikari ..... H01R 13/62933 439/297
2013/0260594 A1 * 10/2013 Lee ..... H01R 13/639 439/345

* cited by examiner

*Primary Examiner* — Truc T Nguyen
(74) *Attorney, Agent, or Firm* — Muncy, Geissler, Olds & Lowe, P.C.

(57) ABSTRACT

A lock structure of a connector assembly includes a socket connector and a plug connector. The socket connector includes a mounting base member and conductive terminals disposed in the mounting base member, and the mounting base member is combined with an outer metal shell. A base of the plug connector includes a plug part combined in the docking chamber, and a connection part, and contact terminals. The base is combined with a shielding housing, and a handle is pivoted to shaft holes of the shielding housing. When the plug connector is not locked on the socket connector, the handle is pushed apart from each other, by the shielding housing, and not clasped on the outer metal shell. After the plug connector is combined on the socket connector, the handle can be rotated to return the handle to original locations, and make the handle clasp on the outer metal shell.

9 Claims, 8 Drawing Sheets

LOCK STRUCTURE OF CONNECTOR ASSEMBLY

BACKGROUND OF THE INVENTION

1. Field of the Invention

The present invention provides a lock structure of the connector assembly, and more particularly to a handle pivoted on a plug connector of a lock structure can be pushed apart by a shielding housing when the plug connector is not locked, so as to make the handle not clasp on the outer metal shell of the socket connector; after the plug connector is combined on the socket connector, the handle can be pulled to rotate to elastically return to original locations, to make the handle clasp on the outer metal shell, so as to facilitate to perform lock or unlock operation.

2. Description of the Related Art

Generally, connectors are used as connection device and auxiliary accessory for electronic signals and power, and the main function of the connector is to provide connection between various electronic devices or apparatuses, and to ensure that the signals can be accurately transmitted. According to different applied products, power and environment, the connectors have developed a variety of different types to be widely used in fields of consumer electronic products such as computers, notebook computers, smart phones, or fields of household appliances, telecommunications or communication equipment. The designs of electronic products are tending to be light, thin, short, and small, the sizes of connectors inside various electronic products need to be greatly reduced, and it is more difficult to connect and fasten the thin connectors with general wires or flexible circuits.

Furthermore, as the volume of electronic product is getting thinner and thinner, the components on the circuit board inside the electronic product must be more precise and miniaturized, and the overall structural strength also needs to be strengthened. A general connector, such as a board-to-board connector or a wire-to-board connector, usually use a male connector and a female connector for matedly connection, to transmit signal or power to a control circuit through a circuit board to execute an operation function; however, in order to reduce the overall structure height, the male connector is usually connected and assembled with the female connector by a mounting manner, and a main body of the male connector is first inserted into a mounting space of the female connector, and convex buckle of the main body is clasped in the buckle groove of the base, so that conductive terminals of the main body can be held in contact with the corresponding contact terminals on the base to form electrical connection, thereby achieving the electrical connection between two parallel circuit boards, or between a flexible circuit board, a cable and a circuit board.

However, because the main body and the base are integrally formed by a colloid made of resin, and the manner of mounting the main body and the base by buckling the convex buckle and the buckle groove may cause abrasion due to multiple insertions and connections, and it causes reduction in the overall mounting force of the connector; when the connector is assembled or disassembled, excessive squeeze may also result in damage to the colloid or the structure of the connector. Furthermore, when the male connector and female connector are connected, conductive terminals and contact terminals are connected through frictional contacts between the single sides thereof, but the fastening effect between these two terminals is not strong enough, and when the male connector and the female connector are impacted or touched by an external force, the male connector may be loosened or separated from the female connector, and it results in unstable signal transmission between the male connector and the female connector.

Therefore, how to solve the above-mentioned problems is a key issue in this industry.

SUMMARY OF THE INVENTION

In order to solve the above-mentioned problems, the inventors develop a lock structure of a connector assembly according to collected data, multiple evaluations and tests, and years of experience.

An objective of the present invention is that a mounting base member of a socket connector of a lock structure can include a plurality of conductive terminals disposed therein, and the mounting base member is combined with a base part of an outer metal shell, and the base part includes two clasping parts disposed on two opposite side surfaces, respectively; and a base of a plug connector of the lock structure includes a plug part disposed on a bottom thereof and combined in the docking chamber, and the base includes a connection part disposed on a rear side of a top thereof, and a plurality of contact terminals disposed therein and electrically connected to a transmission unit fastened on the connection part, and an outer part of the base is combined with a main body of a shielding housing, and the shielding housing includes pushing parts disposed on two opposite sides thereof, and each of the pushing parts has a groove cut through a side thereof, and the groove has a shaft hole cut therethrough, and a handle is pivotally connected to the two shaft holes and configured to be pulled to rotate, and the handle includes two lateral rods extended from two ends of the base rod, respectively, and the two lateral rods have clasping ends inwardly bent from ends thereof relative to each other and pivotally connected to the shaft hole; when the plug connector is not locked on the socket connector, the lateral rods on the two sides of the handle can be pushed by surfaces of the two pushing parts to be apart from each other outwardly, to make the two clasping ends of the handle not clasp on two clasping parts of the outer metal shell; after the plug connector is combined on the socket connector, the handle can be pulled to rotate, to make the lateral rods on two sides of the handle align to the two grooves and return the two lateral rods to original locations elastically, so as to make the two clasping ends of the handle clasp in the two clasping parts of the outer metal shell, and the socket connector and the plug connector can be securely locked integrally, thereby achieving the purpose of improving simplicity and intuition in operation.

Another objective of the present invention is that during the process where the handle is unlocked and rotated, two inner side surfaces, opposite to each other, of the two lateral rods of the handle are guided to slide along guiding surfaces of the two pushing parts, to make the two lateral rods unlock to rotate smoothly, thereby achieving the purpose of improving smoothness in operation.

BRIEF DESCRIPTION OF THE DRAWINGS

The structure, operating principle and effects of the present invention will be described in detail by way of various embodiments which are illustrated in the accompanying drawings.

DETAILED DESCRIPTION OF THE PREFERRED EMBODIMENTS

Figure 1:
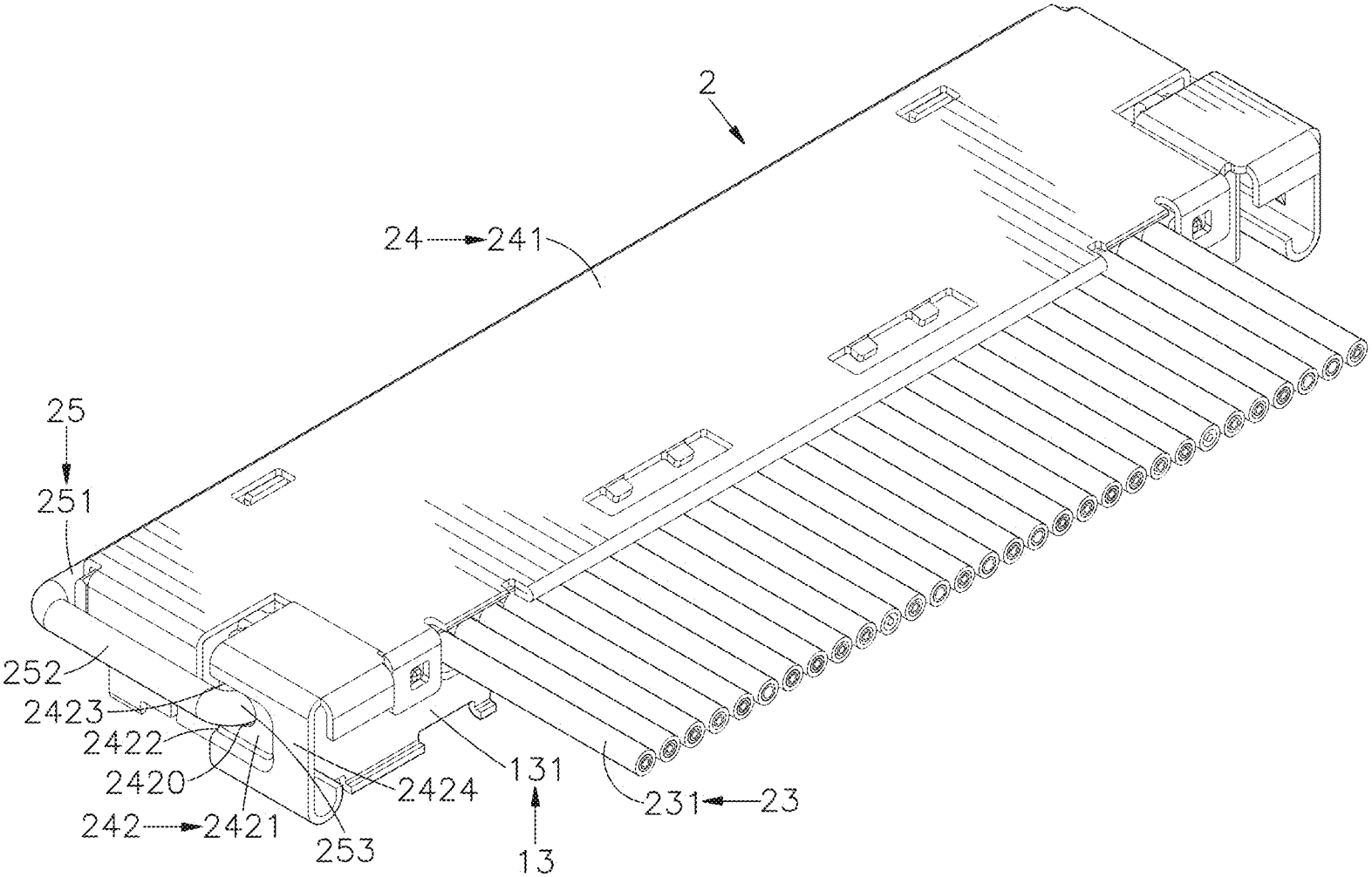
FIG. 1 is a perspective view of a lock structure of a connector assembly, according to the present invention.

The following embodiments of the present invention are herein described in detail with reference to the accompanying drawings. These drawings show specific examples of the embodiments of the present invention. These embodiments are provided so that this disclosure will be thorough and complete, and will fully convey the scope of the invention to those skilled in the art. It is to be acknowledged that these embodiments are exemplary implementations and are not to be construed as limiting the scope of the present invention in any way. Further modifications to the disclosed embodiments, as well as other embodiments, are also included within the scope of the appended claims. These embodiments are provided so that this disclosure is thorough and complete, and fully conveys the inventive concept to those skilled in the art. Regarding the drawings, the relative proportions and ratios of elements in the drawings may be exaggerated or diminished in size for the sake of clarity and convenience. Such arbitrary proportions are only illustrative and not limiting in any way. The same reference numbers are used in the drawings and description to refer to the same or like parts.

It is to be acknowledged that, although the terms 'first', 'second', 'third', and so on, may be used herein to describe various elements, these elements should not be limited by these terms. These terms are used only for the purpose of distinguishing one component from another component. Thus, a first element discussed herein could be termed a second element without altering the description of the present disclosure. As used herein, the term "or" includes any and all combinations of one or more of the associated listed items.

It will be acknowledged that when an element or layer is referred to as being "on," "connected to" or "coupled to" another element or layer, it can be directly on, connected or coupled to the other element or layer, or intervening elements or layers may be present. In contrast, when an element is referred to as being "directly on," "directly connected to" or "directly coupled to" another element or layer, there are no intervening elements or layers present.

In addition, unless explicitly described to the contrary, the word "comprise" and variations such as "comprises" or "comprising", will be acknowledged to imply the inclusion of stated elements but not the exclusion of any other elements.

Figure 2:
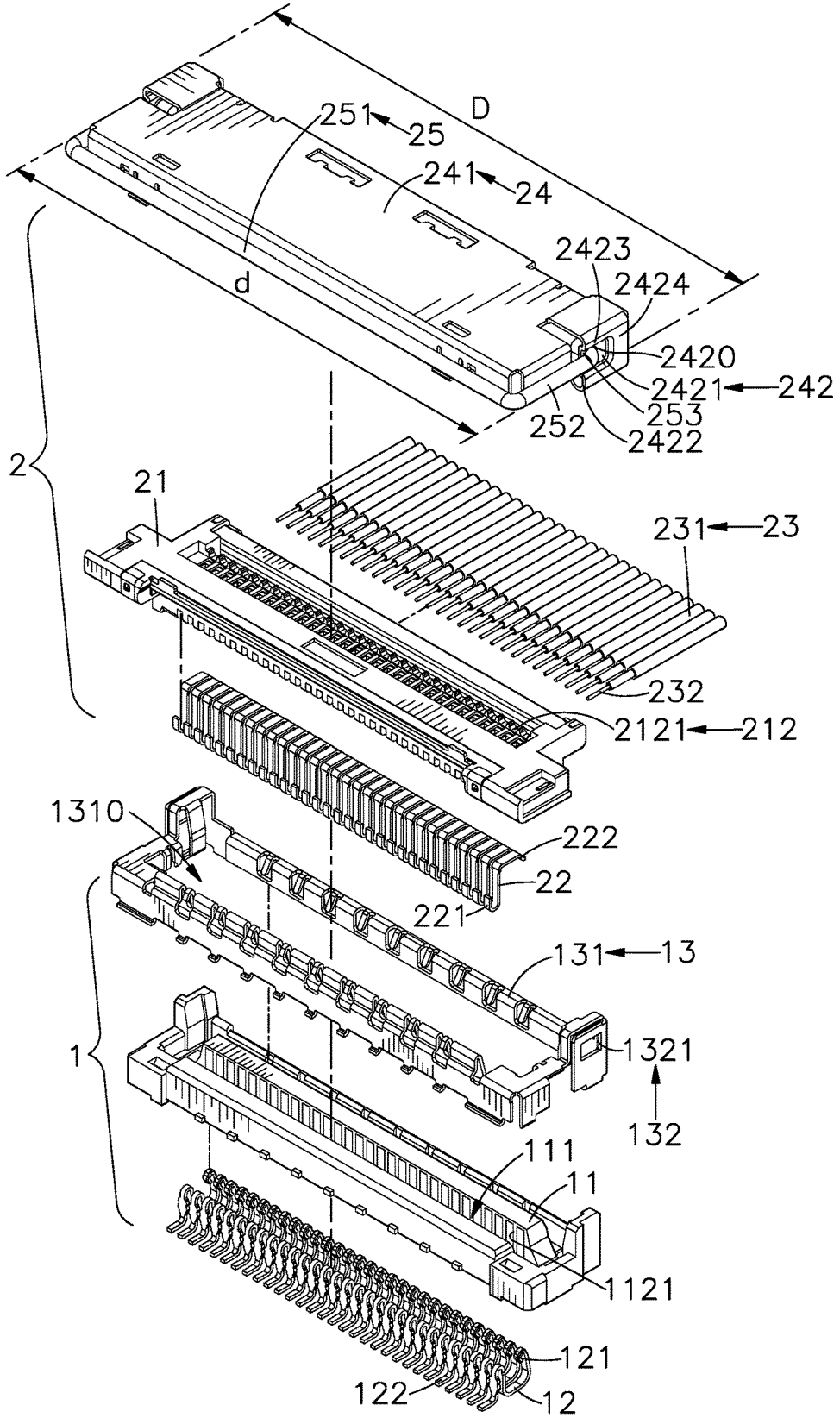
FIG. 2 is a perspective exploded view of a lock structure of a connector assembly, according to the present invention.
Figure 3:
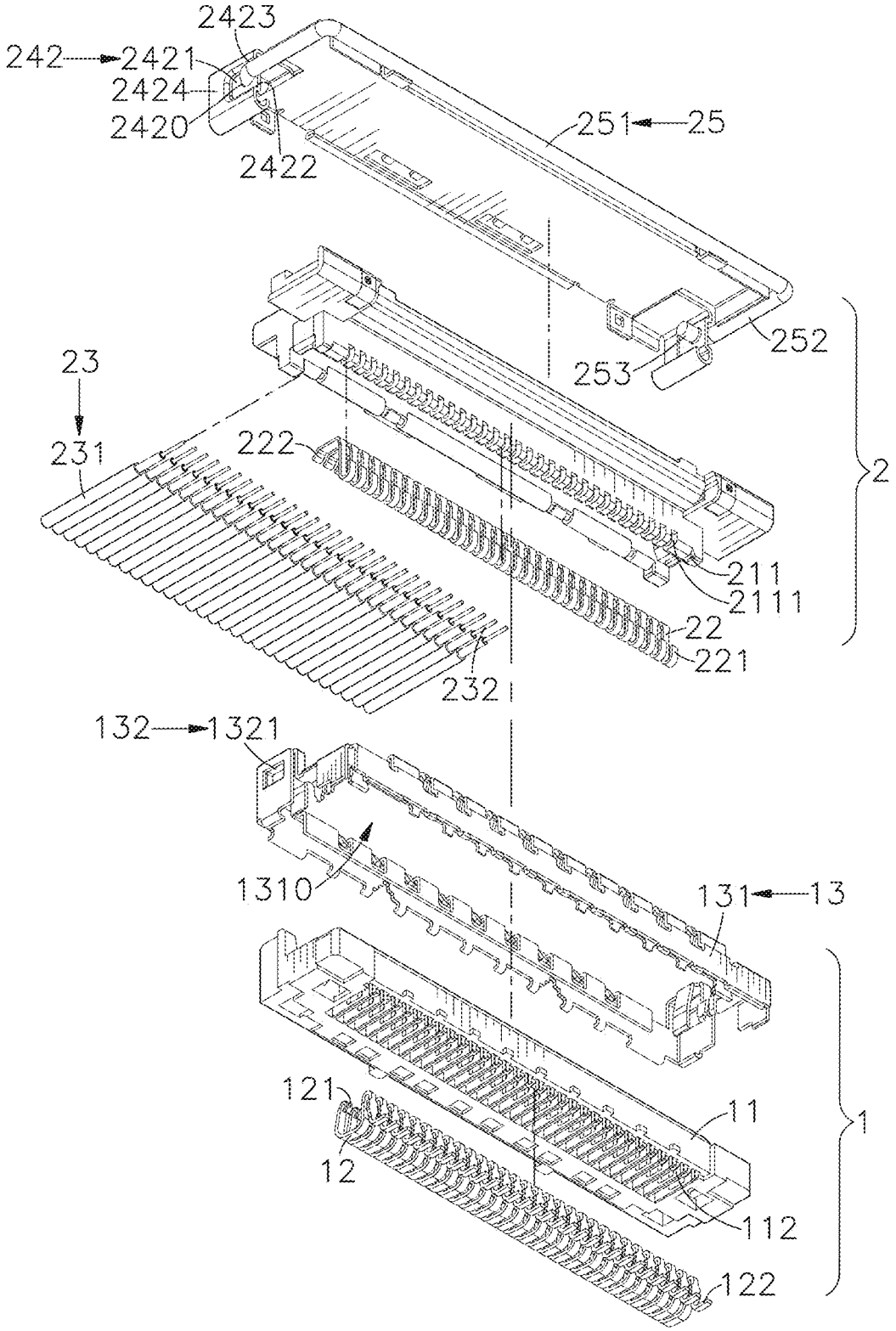
FIG. 3 is a perspective exploded view of a lock structure of a connector assembly, according to the present invention when viewed from another angle.
Figure 4:
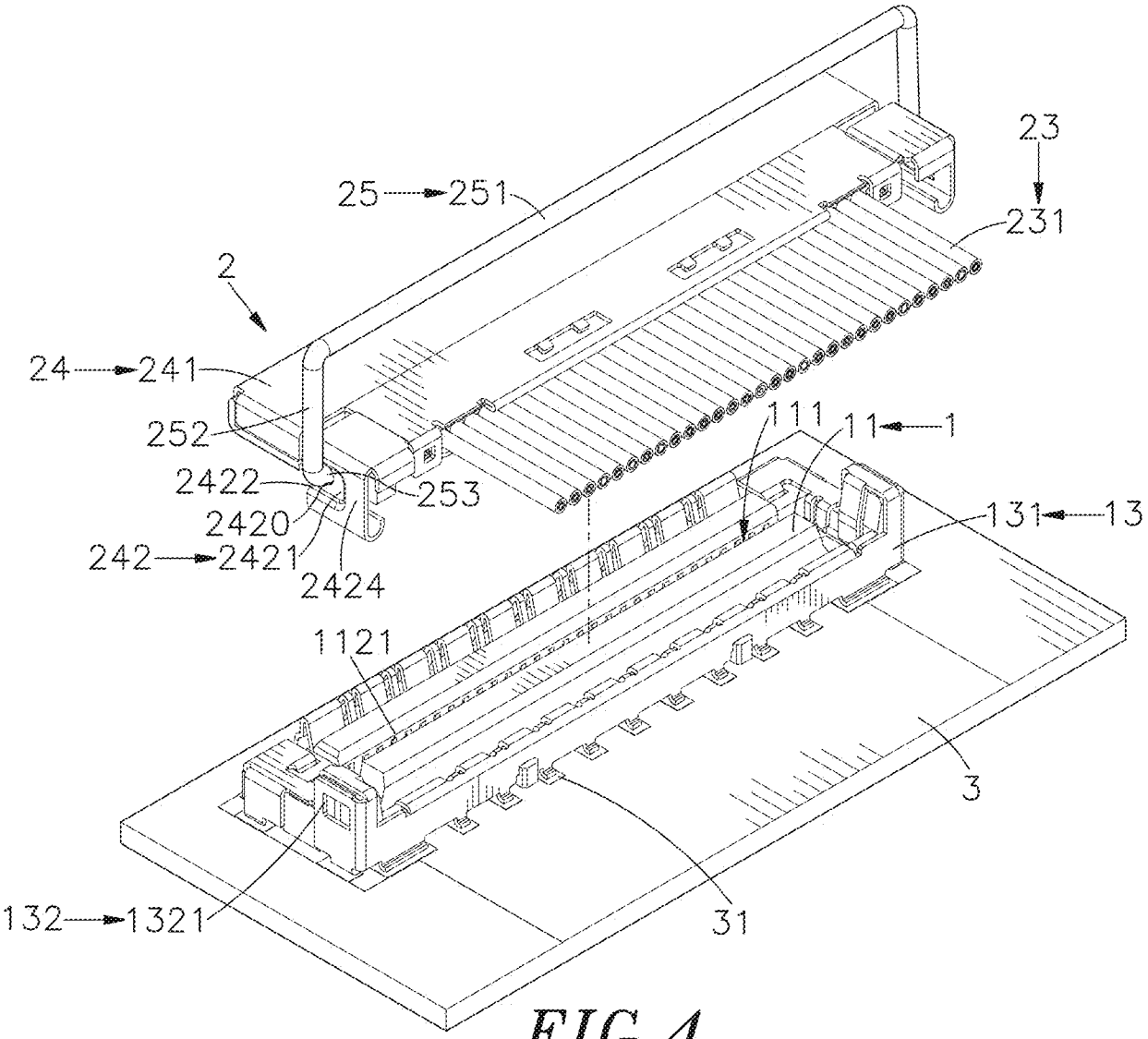
FIG. 4 is a perspective view of a lock structure of a connector assembly before a socket connector and a plug connector are connected with each other, according to the present invention.
Figure 5:
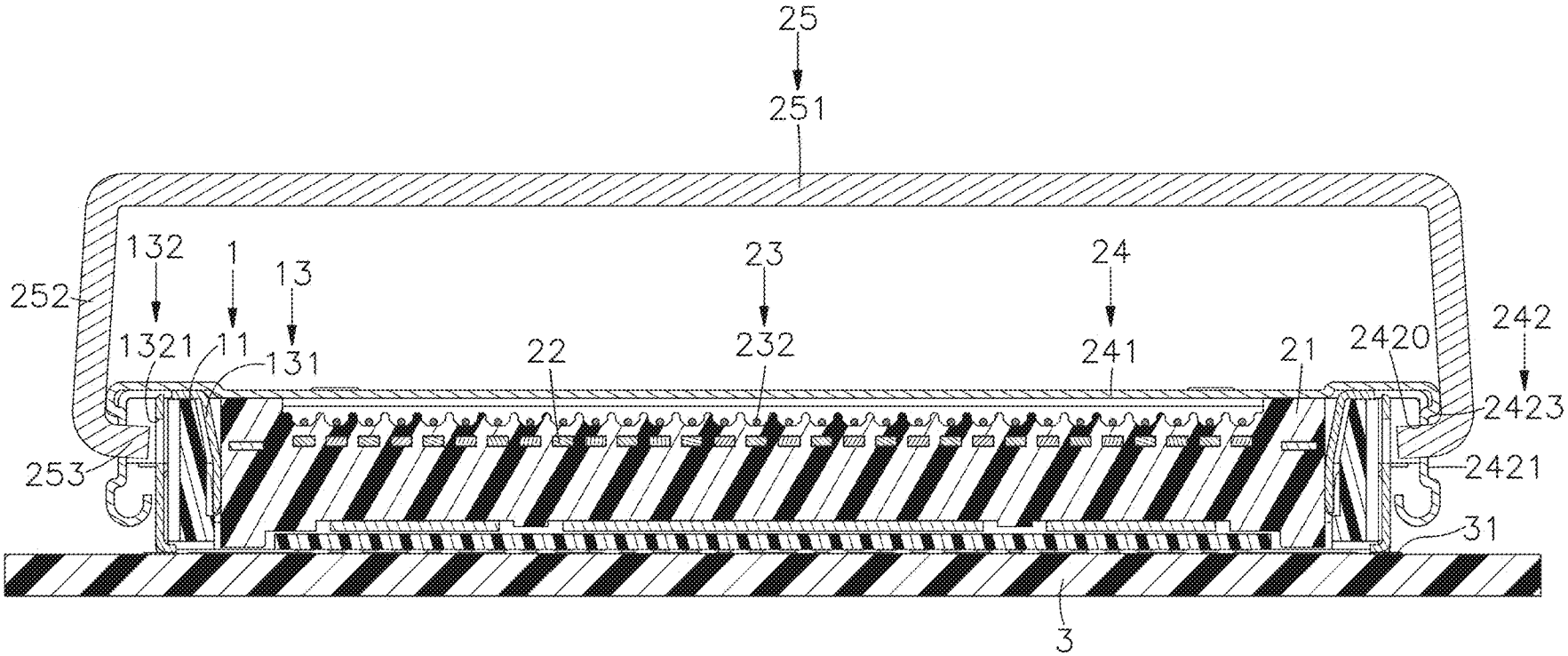
FIG. 5 is a sectional front view of the lock structure of the connector assembly when the socket connector and the plug connector are connected with each other, according to the present invention.
Figure 6:
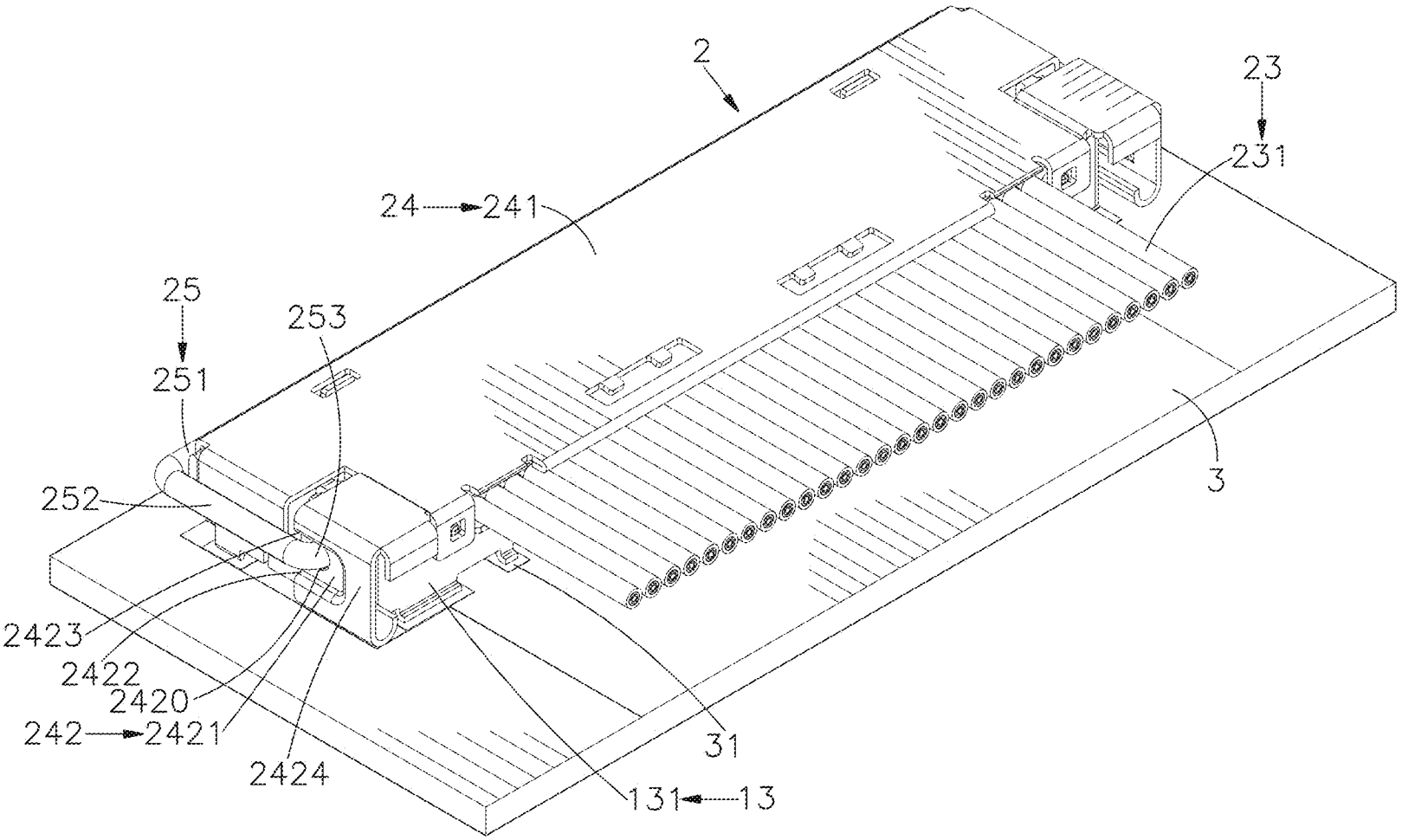
FIG. 6 is a perspective view of the lock structure of the connector assembly after the socket connector and the plug connector are connected with each other, according to the present invention.
Figure 7:
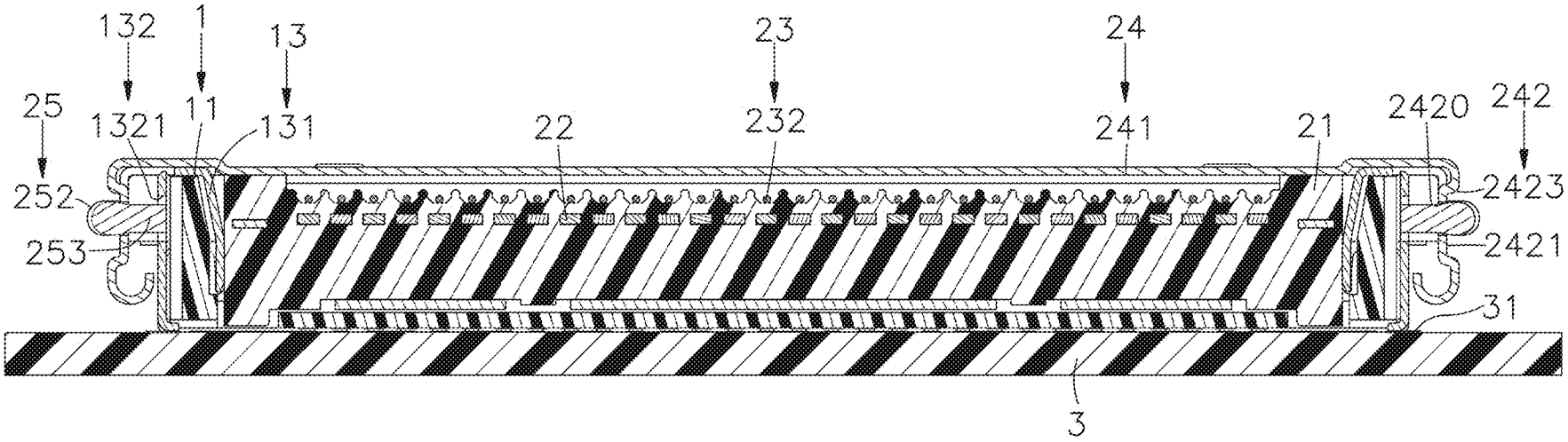
FIG. 7 is a sectional front view of the lock structure of the connector assembly after the socket connector and the plug connector are connected with each other are connected, according to the present invention.
Figure 8:
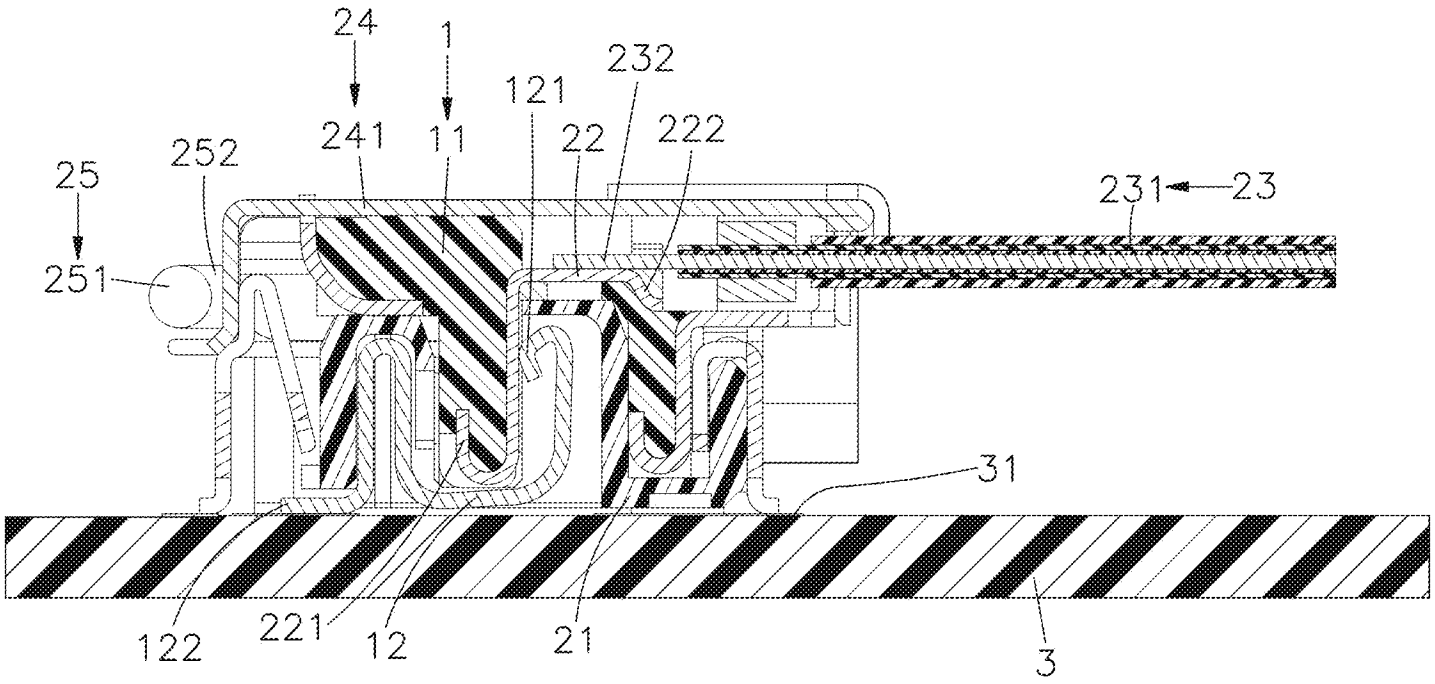
FIG. 8 is a sectional side view of the lock structure of the connector assembly after the socket connector and the plug connector are connected with each other are connected, according to the present invention.

Please refer to FIGS. 1 to 3, which are a perspective view and perspective exploded views of a lock structure of a connector assembly of the present invention when viewed from different angles. As shown in FIGS. 1 to 3, a lock structure includes a socket connector 1 and a plug connector 2.

The socket connector 1 includes a mounting base member 11, a plurality of conductive terminals 12, and an outer metal shell 13 in rectangular shape. The mounting base member 11 has a docking chamber 111 recessed therein, and a plurality of terminal slots 112 recessed on a bottom thereof and in communication with the docking chamber 111. Each of the plurality of terminal slots 112 has a through hole 1121 cut through a side thereof adjacent to the docking chamber 111 and in communication with the docking chamber 111. The plurality of conductive terminals 12 are inserted into the plurality of terminal slots 112, respectively, and each of the plurality of conductive terminals 12 has a butt joint terminal 121 bent and extended from an end thereof and configured to pass through the through hole 1121 to locate in the docking chamber 111, and a connection terminal 122 bent and extended from other end thereof disposed out of the mounting base member 11. The mounting base member 11 is combined with a frame-shaped base part 131 of the outer metal shell 13, and the base part 131 has a pass hole 1310 formed therein and configure to expose the docking chamber 111, and the base part 131 includes two clasping parts 132 disposed on two opposite side surfaces thereof, respectively, and each of the two clasping parts 132 has a buckle hole 1321 in a rectangular shape.

The plug connector 2 includes a rectangular base 21, a plurality of contact terminals 22, a transmission unit 23, a shielding housing 24 and a handle 25. The base 21 includes a plug part 211 protruded on a bottom thereof, and the plug part 211 includes a plurality of accommodating grooves 2111 recessed on a bottom thereof and arranged in interval. The base 21 includes a connection part 212 disposed on a rear side of a top thereof and having a plurality of wire receiving slots 2121 arranged in interval, and the plug part 211 of the base 21 has the plurality of contact terminals 22 formed therein, and each of the plurality of the contact terminals 22 has a contact part 221 bent and extended from a side thereof and disposed in the one of the plurality of accommodating grooves 2111, and a solder part 222 bent and extended from other side thereof disposed on a top of the base 21. The solder parts 222 of the plurality of contact terminals 22 are electrically connected to the transmission unit 23, and the transmission unit 23 includes a plurality of conductive wires 231 fastened in the plurality of wire receiving slots 2121 of the connection part 212, respectively, and each of the plurality of conductive wires 231 has a wire core 232 extended from and exposed out of a side thereof and electrically connected on the solder part 222 of the corresponding one of the plurality of contact terminals 22. An outer part of the base 21 is combined with the shielding housing 24, and the shielding housing 24 includes a main body 241 covering the base 21, and two pushing parts 242 disposed on two opposite sides thereof, respectively. Each pushing part 242 has a groove 2421 laterally cut through a side thereof, and the groove 2421 has an opening 2422 laterally formed on a side thereof, and a guiding surface 2423 formed on a top thereof and in a circular curved-shape. The two pushing parts 242 have supporting surfaces 2424 formed on two opposite outer side surfaces and around the grooves 2421, respectively, and each groove 2421 has a shaft hole 2420 cut therethrough. The handle 25 is pivotally connected to the two shaft holes 2420, the handle 25 is in an about inverted-U shape and includes a base rod 251, and the base rod 251 includes two lateral rods 252 extended on two ends thereof, respectively, and two lateral rods 252 have clasping ends 253 inwardly bent from ends thereof relative to each other, and pivotally connected to the shaft holes 2420, respectively. A distance "d" between the two lateral rods 252 is smaller than a distance "D" between the two supporting surfaces 2424.

Preferably, the base 21 and the plurality of contact terminals 22 of the plug connector 2 can be manufactured integrally by an insert molding manner using plastic material; however, in actual application, the plurality of contact terminals 22 can be assembled in the base 21 by an engaging, constraining, tightly packing or other assembling manner. It should be noted that there are many manners of combining the plurality of contact terminals 22 on the base 21, so various equivalent structural changes, alternations or modifications based on the descriptions and figures of present invention are all consequently viewed as being embraced by the spirit and the scope of the present invention set forth in the claims.

Preferably, the transmission unit 23 of the plug connector 2 can be implemented by the plurality of conductive wires 231; however, in actual application, the transmission unit 23 can be implemented by flexible printed circuit board (FPC), a flexible flat cable, or a circuit board. Preferably, the transmission unit 23 is electrically connected to the solder parts 222 of the plurality of contact terminals 22 by a soldering manner; however, in actual application, the suppressing manner or through-hole connection manner can be used to form electric connection. It should be noted that there are many manners of combining the transmission unit 23 on the plurality of contact terminals 22, so various equivalent structural changes, alternations or modifications based on the descriptions and figures of present invention are all consequently viewed as being embraced by the spirit and the scope of the present invention set forth in the claims.

Please refer to FIGS. 4 to 8, which are a perspective view of a lock structure of a connector assembly before a socket connector and a plug connector are connected with each other, a sectional front view of the lock structure of the connector assembly when the socket connector and the plug connector are connected with each other, and a perspective view, a sectional front view and a sectional side view of the lock structure of the connector assembly after the socket connector and the plug connector are connected with each other. As shown in FIGS. 4 to 8, the socket connector 1 can be first electrically connect the connection terminal 122 of the plurality of conductive terminals 12 to a plurality of contacts 31 on the a of a circuit board 3 by the surface mount technology, the through-hole manner or other electric connection manner; before the socket connector 1 and the plug connector 2 are matedly connected, the handle 25 of the plug connector 2 can be upwardly turned in advance, and the distance (A) between the lateral rods 252 on two sides of the handle 25 is smaller than the distance (B) between the supporting surfaces 2424 of the two pushing parts 242, so the lateral rods 252 on the two sides of the handle 25 are outwardly pushed apart from each other by the supporting surfaces 2424 of the two pushing parts 242, to make the base 21 of the plug connector 2 downwardly assemble on the mounting base member 11 of the socket connector 1 and make the plug part 211 of the base 21 insert into the docking chamber 111 of the mounting base member 11; at this time, the contact parts 221 of the contact terminals 22 are in electric contact with the butt joint terminals 121 of the plurality of conductive terminals 12, to form an electrical conduction status.

After the plug connector 2 is downwardly assembled on the socket connector 1, the base rod 251 of the handle 25 can be rotated in the counterclockwise direction, to axially rotate the two clasping ends 253 of the handle 25 in the shaft holes 2420 on the two sides of the pushing part 242, so that the base rod 251 of the handle 25 is rotated to the front of the plug connector 2, and the two lateral rods 252 of the handle 25 are aligned to the grooves 2421 of the two pushing parts 242 and forwardly extended from the openings 2422 of the two pushing parts 242; at this time, the supporting surfaces 2424 of the two pushing parts 242 are not abutted against the opposite inner sides of the two lateral rods 252 of the handle 25, so that the two lateral rods 252 of the handle 25 can elastically return to original locations to make the two clasping ends 253 of the handle 25 buckle into, and clasped and fastened with the buckle holes 1321 of the clasping parts 132 on two sides of the outer metal shell 13; as a result, the socket connector 1 and the plug connector 2 can be securely locked integrally.

In order to separate the plug connector 2 from the socket connector 1, the base rod 251 of the handle 25 can be rotated in the clockwise direction, to pull the handle 25 back to the above location; during the process where the handle 25 is rotated in the clockwise direction, two inner side surfaces, opposite to each other, of the two lateral rods 252 of the handle 25 are guided to slide along the guiding surfaces 2423 of the two pushing parts 242, and the two lateral rods 252 can be smoothly rotated in the clockwise direction; at the same time, the lateral rods 252 on two sides of the handle 25 are outwardly pushed apart from each other by the supporting surface 2424 of the two pushing parts 242, to make the two clasping ends 253 of the handle 25 not buckle into the buckle holes 1321 of the clasping parts 132 on two sides of the outer metal shell 13, so that the socket connector 1 and the plug connector 2 can form an unlocked state; next, the plug connector 2 can be upwardly pulled to separate the contact parts 221 of the plurality of contact terminals 22 from the butt joint terminals 121 of the plurality of conductive terminals 12; as a result, the operation of the lock structure of the present invention can be completed.

According to above-mentioned contents, the lock structure of the present invention has following advantages.

First, when the plug connector 2 is not locked on the socket connector 1, the lateral rods 252 on the two sides of the handle 25 are pushed by the surfaces of the two pushing parts 242 to be apart from each other outwardly, so as to make the two clasping ends 253 of the handle 25 not clasp on two clasping parts 132 of the outer metal shell 13; after the plug connector 2 is combined on the socket connector 1, the handle 25 can be rotated to make the lateral rods 252 on two sides of the handle 25 align to the two grooves 2421, to return the two lateral rods 252 to original locations elastically, so that the two clasping ends 253 of the handle 25 can be clasped in the two clasping parts 132 of the outer metal shell 13, respectively, and the socket connector 1 and the plug connector 2 can be securely locked integrally, and the user can just use the handle 25 to lock or unlock the socket connector 1 and the plug connector 2 effortlessly, thereby achieving the effect of improving simplicity and intuition in operation.

Secondly, during the process where the handle 25 is unlocked and rotated, the opposite inner side surfaces of the two lateral rods 252 of the handle 25 are guided to slide along the guiding surface 2423 of the two pushing parts 242, so as to make the two lateral rods 252 unlock to rotate smoothly, thereby achieving the effect of improving smoothness in operation.

The present invention disclosed herein has been described by means of specific embodiments. However, numerous modifications, variations and enhancements can be made thereto by those skilled in the art without departing from the spirit and scope of the disclosure set forth in the claims.

What is claimed is:

1. A lock structure of a connector assembly, comprising:

a socket connector comprising a mounting base member, a plurality of conductive terminals and an outer metal shell, wherein the mounting base member has a docking chamber recessed therein and the plurality of conductive terminals disposed therein, and each of the plurality of conductive terminals comprises a butt joint terminal extended from an end thereof and disposed in the docking chamber and a connection terminal extended from other end thereof and disposed out of the mounting base member, and the mounting base member is combined with a base part of the outer metal shell, and the base part comprises two clasping parts disposed on two opposite side surfaces thereof, respectively;

a plug connector comprising a base, a plurality of contact terminals, a transmission unit, a shielding housing and a handle, wherein the base comprises a plug part disposed on a bottom thereof and combined in the docking chamber, and a connection part disposed on a rear side of a top thereof, and the base comprises the plurality of contact terminals disposed therein, and each of the plurality of contact terminals comprises a contact part extended from a side thereof and exposed out of the plug part, and a solder part extended from other side thereof and disposed out of the base, and a plurality of solder parts are electrically connected to the transmission unit fastened on the connection part, and an outer part of the base is combined with the shielding housing, and the shielding housing comprises a main body covering the base, and pushing parts disposed on two opposite sides of the shielding housing, respectively, and each of the pushing parts has a groove cut through a side thereof, and the groove has a shaft hole cut therethrough, and the handle is pivotally connected to the two shaft holes and configured to be pulled to rotate, the handle comprises a base rod, and two lateral rods extended on two ends of the base rod, respectively, and the two lateral rods have clasping ends inwardly bent from ends thereof relative to each other and pivotally connected to the shaft hole, and a distance between the two lateral rods is smaller than a distance between two supporting surfaces;

wherein when the plug connector is not locked on the socket connector, the lateral rods on two sides of the handle are pushed by surfaces of the pushing parts to be outwardly pushed apart from each other, and the two clasping ends of the handle are not clasped on the two clasping parts of the outer metal shell, and when the handle is pulled to make the plug connector lock with the socket connector, the lateral rods on the two sides of the handle are aligned to the two grooves and the two lateral rods are not pushed by the surfaces of the two pushing parts, the two clasping ends of the handle are elastically clasped on the two clasping parts of the outer metal shell.

2. The lock structure of the connector assembly according to claim 1, wherein the mounting base member of the socket connector comprises a plurality of terminal slots recessed on a bottom thereof, in communication with the docking chamber and configured to fasten the plurality of conductive terminals, and each of the plurality of terminal slots has a through hole cut through a side thereof adjacent to the docking chamber, in communication with the docking chamber and configured to pass through the butt joint terminal of one of the plurality of conductive terminals.

3. The lock structure of the connector assembly according to claim 1, wherein the base part of the outer metal shell has a pass hole formed therein and configured to expose the docking chamber.

4. The lock structure of the connector assembly according to claim 1, wherein the clasping parts of the outer metal shell have buckle holes configured to buckle with the clasping ends of the handle, respectively.

5. The lock structure of the connector assembly according to claim 1, wherein the plug part of the base comprises a plurality of accommodating grooves recessed on a bottom thereof and configured to fasten the contact parts of the plurality of contact terminals.

6. The lock structure of the connector assembly according to claim 1, wherein the connection part of the base has a plurality of wire receiving slots arranged in interval, and the transmission unit comprises a plurality of conductive wires fastened in the plurality of wire receiving slots, respectively, and each of the plurality of conductive wires has a wire core extended from and exposed out of a side thereof and electrically connected on the solder part of one of the plurality of contact terminals.

7. The lock structure of the connector assembly according to claim 1, wherein each of the grooves has an opening laterally formed on a side thereof and configured to pass one of the two lateral rods of the handle in a lock status.

8. The lock structure of the connector assembly according to claim 1, wherein each of the grooves has a guiding surface formed on a top thereof and is in a circular curved-shape.

9. The lock structure of the connector assembly according to claim 1, wherein the two pushing parts have the supporting surfaces formed on outer side surfaces thereof relative to each other and disposed around the grooves, respectively, and configured to outwardly push the lateral rods on two sides of the handle apart from each other.

* * * * *